United States Patent [19]

Okumura et al.

[11] Patent Number: 5,050,709

[45] Date of Patent: Sep. 24, 1991

[54] ELEVATOR CONTROL APPARATUS

[75] Inventors: Masahide Okumura; Shigemi Iwata, both of Inazawa, Japan

[73] Assignee: Mitsubishi Denki Kabushiki Kaisha, Tokyo, Japan

[21] Appl. No.: 552,220

[22] Filed: Jul. 13, 1990

[30] Foreign Application Priority Data

Jul. 18, 1989 [JP] Japan ..... 1-184934

[51] Int. Cl.[5] ..... B66B 1/30

[52] U.S. Cl. ..... 187/116; 187/119

[58] Field of Search ..... 187/116, 119

[56] References Cited

U.S. PATENT DOCUMENTS

| | | | |
|---|---|---|---|
| 4,503,937 | 3/1985 | Cervenec et al. | 187/119 |
| 4,600,088 | 7/1986 | Yonemoto | 187/119 |
| 4,624,343 | 11/1986 | Tanahashi et al. | 187/119 |
| 4,625,834 | 12/1986 | Tanahashi | 187/119 |
| 4,629,035 | 12/1986 | Tanahashi et al. | 187/119 |
| 4,671,389 | 6/1987 | Tanahashi | 187/119 |
| 4,779,708 | 10/1988 | Sasao et al. | 187/119 |
| 4,804,067 | 2/1989 | Kähkipuro | 187/119 |
| 4,817,761 | 4/1989 | Iwata et al. | 187/116 |
| 4,844,205 | 7/1989 | Klingbeil | 187/116 |
| 4,851,982 | 7/1989 | Tanahashi | 187/119 X |

FOREIGN PATENT DOCUMENTS 60-6574 9/1985 Japan .

*Primary Examiner*—A.D. Pellinen

*Assistant Examiner*—W. E. Duncanson, Jr.

*Attorney, Agent, or Firm*—Leydig, Voit & Mayer

[57] ABSTRACT

An elevator control apparatus which compensates for an insufficient gain of the entire control system caused by a drop in power source voltage or the like includes an electric power control circuit for controlling electric power for feeding to an electric motor which drives the car of an elevator, a speed command generating circuit for generating a speed command signal of the car, a speed detecting circuit for detecting the speed of the car, a computing circuit for calculating the deviation between a speed detecting signal obtained by the speed detecting device and a speed command signal generated by the speed command generating circuit, a compensating circuit for outputting an electric power command signal in which gain properties and phase properties have been compensated in accordance with the deviation calculated by the computing circuit, a comparing circuit for determining whether or not the deviation calculated by the computing circuit exceeds a first specified value, and a damping gain setting circuit for, when the comparing circuit determines that the deviation exceeds the first specified value, adding a correction value which is based on the deviation to the electric power command signal from the compensating circuit in order to output the added correction value as an electric power control signal to the electric power control circuit.

4 Claims, 5 Drawing Sheets

ELEVATOR CONTROL APPARATUS

BACKGROUND OF THE INVENTION

1. Field of the Invention

The present invention relates to an elevator control apparatus, and more particularly to an elevator control apparatus which compensates for an insufficient gain of the entire control system caused by a drop in power source voltage.

2. Description of the Related Art

Elevator control apparatuses perform highly accurate speed control in such a manner that, generally, the apparatus detects the speed of a car, compares the detected speed value with a speed command value, and returns to a speed control system in the form of feedback, a signal showing the difference between the two values thereby obtained.

In elevators utilizing a three-phase induction motor, it is required that the control system be stabilized to perform better speed control in consideration of various disturbance factors, such as variations in power source voltage.

FIG. 6 is a schematic diagram illustrating a conventional speed control circuit for an elevator disclosed in Japanese Patent Laid-Open No. 60-6574.

In FIG. 6, a speed control circuit 60 includes a subtracter 61 for calculating the difference between a speed command signal VP and a speed detecting signal VT, and a compensator 62 for compensating for, based on a deviation output "e" of the subtracter 61, the gain and phase properties of the control system.

The compensator 62 is composed of an analog circuit, and one having a transfer function G(S) usually expressed in the following equation is utilized.

$$G(S) = K \cdot \frac{1 + ST2}{1 + ST1}$$

where K is a gain, T1 and T2 are time constants, and S is a Laplace operator.

In such a conventional speed control circuit as constructed above, to improve riding comfort and precision of stopping at a floor, the compensator 62 compensates for gain as well as phase, and the ignition angle of an unillustrated thyristor is controlled by adding the compensated voltage signal V0 to the thyristor, as a control signal.

There are problems in that since the generating torque of an induction motor in the conventional elevator control apparatus as described above depends generally upon the input voltage and, in detail, is proportional to the square of the input voltage, the gain of the entire control system diminishes if the voltage drops owing to variations in the power source voltage or the like. With this diminution, the response of the control system to a speed command markedly decreases, thereby causing inaccuracy of stopping of a car at a floor or riding discomfort.

In order to overcome the above problems, it is possible to keep the gain of the entire control system constantly high, allowing for variations in the power source voltage or the like. However, a problem exists in that this makes the control system unstable and the car easily vibrates, thereby causing riding discomfort. Moreover, setting of a gain corresponding to variations in the power source voltage or the like demands a detecting circuit for detecting the variations in the power source voltage or the like, resulting in raised cost as well as complicated hardware structures.

SUMMARY OF THE INVENTION

The present invention overcomes the foregoing problems. An object of the invention is to provide an elevator control apparatus which permits improving highly accurate stopping at a floor and riding comfort without being affected by variations in power source voltage or the like.

The present invention provides an elevator control apparatus comprising an electric power control means for controlling electric power for feeding to an electric motor which drives the car of an elevator, a speed command generating means for generating a speed command signal of the car, a speed detecting means for detecting the speed of the car, a computing means for calculating the deviation between a speed detecting signal obtained by the speed detecting means and a speed command signal generated by the speed command generating means, a compensating means for outputting an electric power command signal in which gain properties and phase properties have been compensated in accordance with the deviation calculated by the computing means, a comparing means for determining whether or not the deviation calculated by the computing means exceeds a first specified value, and a damping gain setting means for, when the comparing means determines that the deviation exceeds the first specified value, adding a correction value which is based on the deviation to the electric power command signal from the compensating means in order to output the added correction value as an electric power control signal to the electric power control means.

Other features and advantages of the present invention will be apparent from the following description taken in conjunction with the accompanying drawings, in which like reference characters designate the same or similar parts through the figures thereof.

DESCRIPTION OF THE PREFERRED EMBODIMENT

An embodiment of the present invention will be hereinafter described with reference to FIGS. 1 through 5.

Figure 1:
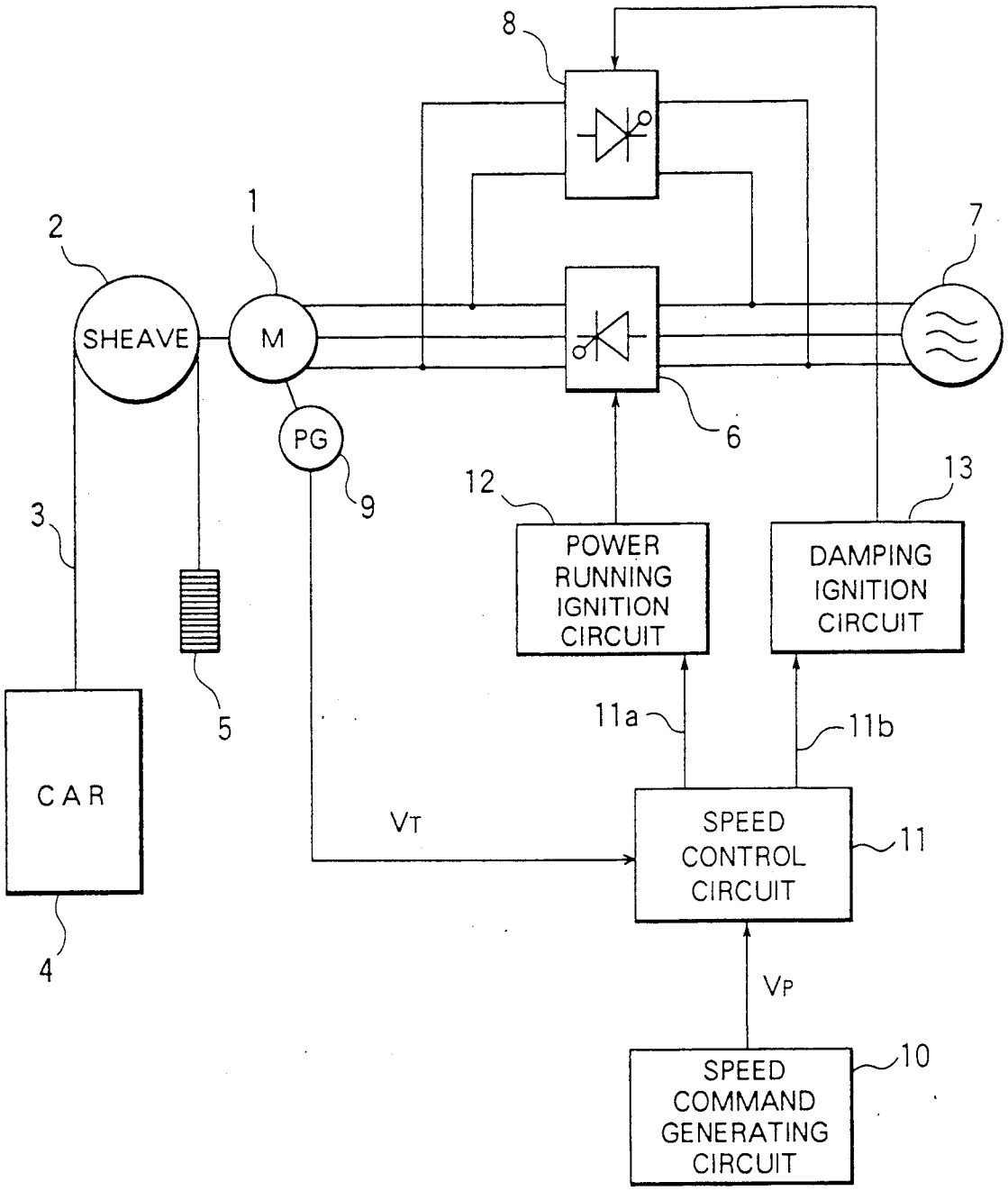
FIG. 1 is a block diagram illustrating one embodiment of an elevator control apparatus according to the present invention.

In FIG. 1, a sheave 2 is connected through a winding machine (not shown) to a three-phase induction motor 1 for driving a car 4. The car 4 is attached to one end of a rope 3 wound around the sheave 2, whereas a counter weight 5 is attached to the other end of the rope 3. Further, the induction motor 1 is connected via a thyristor device 6 for power running purposes to a three-phase AC power source 7, and a thyristor device 8 for damping purposes is connected between the induction motor 1 and the AC power source 7 in parallel with the thyristor device 6. Numeral 9 denotes a pulse generator directly connected to the induction motor 1 for detecting the speed of the car 4; numeral 10 denotes a speed command generating circuit; and numeral 11 indicates a speed control circuit which controls the speed of the induction motor 1 based on a speed command signal VP from the speed command generating circuit 10 and a speed detecting signal VT from the pulse generator 9. A power running ignition circuit 12 which controls, by a power running torque command 11*a* from the speed control circuit 11, the power running thyristor device 6, and a damping ignition circuit 13 which controls, by a damping torque command 11*b*, the damping thyristor device 8, are connected to the speed control circuit 11.

Figure 2:
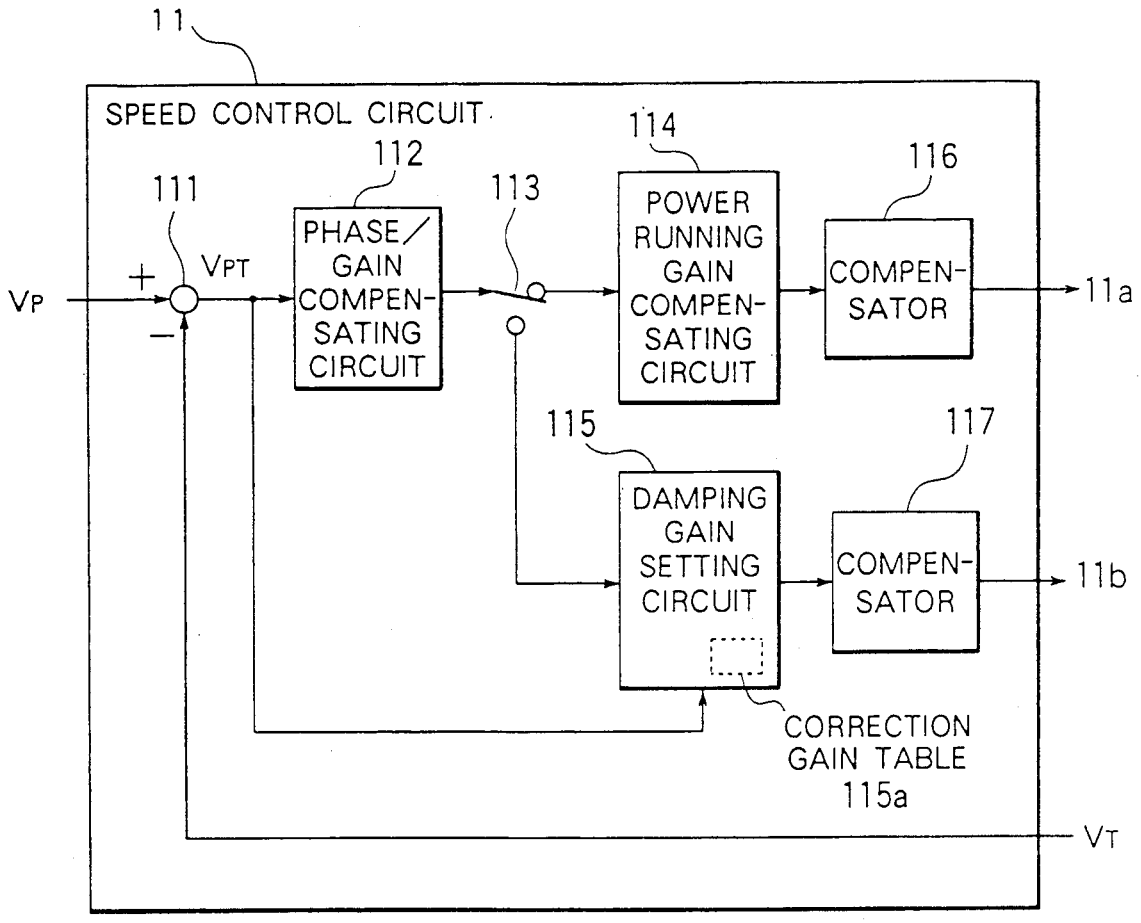
FIG. 2 is a block diagram illustrating a speed control circuit in the embodiment.

FIG. 2 illustrates the internal structure of the speed control circuit 11. The speed control circuit 11 has a subtracter 111 that computes a deviation VPT between the speed command signal VP from the speed command generating circuit 10 and the speed detecting signal VT from the pulse generator 9. A phase/gain compensating circuit 112 for compensating for the phase and gain of the speed control system, on the basis of the deviation VPT, is connected to the subtracter 111. A power running gain compensating circuit 114, which compensates for the gain of the control system with respect to power running when the deviation VPT is positive, and a damping gain setting circuit 115, which replenishes a deficient gain of the control system and which re-sets gain with respect to damping when the deviation VPT is negative, are connected via a switch 113 to the phase/gain compensating circuit 112. A compensator 116, for compensating for various non-linear elements to output a linear power running ignition command 11*a*, is connected to the power running gain compensating circuit 114, whereas a compensator 117, for compensating for various non-linear elements to output a linear damping ignition command 11*b*, is connected to the damping gain setting circuit 115.

A correction gain table 115*a* composed of a ROM, in which correction data for used in replenishing an insufficient damping gain of the entire control system caused by a drop in the power source voltage or the like is stored, is provided in the damping gain setting circuit 115. The insufficient gain of the entire control system is compensated in such a manner that the damping gain setting circuit 115 computes, based on the deviation VPT calculated by the subtracter 111, an extract address of the correction gain table 115*a* and extracts correction data, by using the extract address, from the correction gain table 115*a* in order to add the correction data to the damping gain obtained up to this point.

Figure 3:
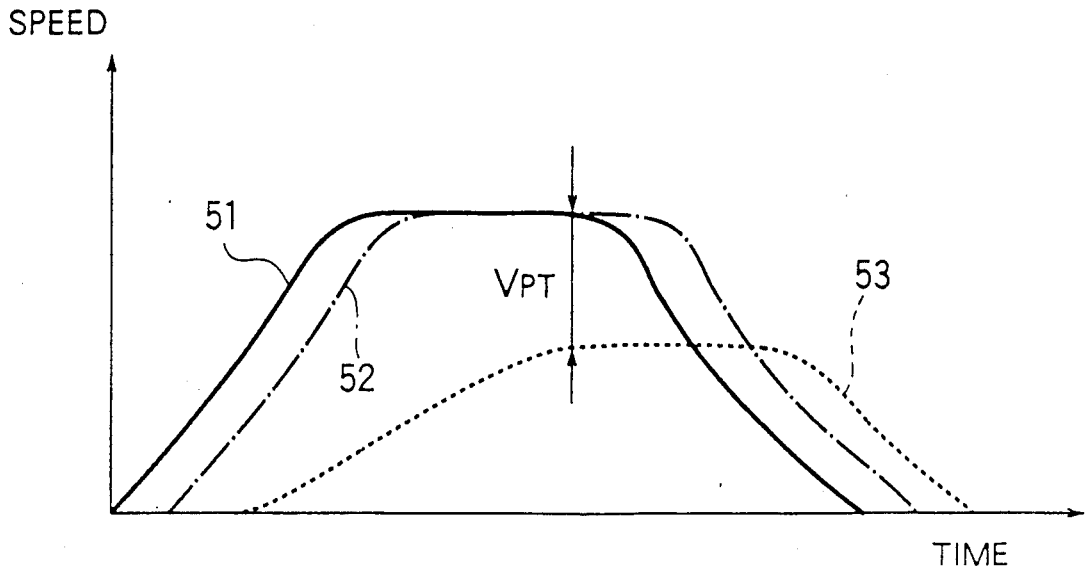
FIG. 3 is a graph showing the relationship between a speed command value and an actual speed of a car.

FIG. 3 illustrates the changes between the states of the actual speeds 52 and 53 of the car 4 with respect to the speed command value 51 of the speed command signal VP. There is little deviation between the speed command value 51 and the actual speed 52 of the car at normal power source voltage during a constant running of the car 4. On the contrary, a great deviation VPT occurs between the speed command value 51 and the actual speed 53 of the car when the power source voltage drops, and the greater the power source voltage drops, the greater the deviation VPT becomes. Accordingly, it is required that the insufficient gain corresponding to the deviation VPT be compensated for.

The operation of this embodiment will now be described. Upon inputting the speed command signal VP, commanding the speed of the car 4, from the speed command generating circuit 10 to the speed control circuit 11, the speed control circuit 11 outputs a power running torque command 11*a* through the phase/gain compensating circuit 112, the switch 113, the power running gain compensating circuit 114 and the compensator 116. The power running ignition circuit 12 controls the thyristor 6 through this power running torque command 11*a*, thereby causing electric power to be fed from the AC power source 7 to the motor 1. Once the car 4 starts operating in such a fashion, the speed of the car 4 is detected by the pulse generator 9 and is input to the speed control circuit 11 as the speed detecting signal VT.

The subtracter 111 inside the speed control circuit 11 computes the deviation VPT (=VP−VT) between the speed command signal VP from the speed command generating circuit 10 and the speed detecting signal VT from the pulse generator 9. The phase/gain compensating circuit 112 compensates for phase as well as gain based on the deviation VPT, thereby outputting an electric power command signal. Further, the switch 113 switches over to the power running gain compensating circuit 114 when the deviation VPT is positive, whereas it switches over to the damping gain setting circuit 115 when the deviation VPT is negative.

Thus, on the one hand, when the deviation VPT is positive, the electric power command signal from the phase/gain compensating circuit 112 is input to the power running gain compensating circuit 114, where the gain of the signal with respect to the power running is compensated for before the non-linear elements of the signal are further compensated for in the compensator 116, and the linear power running ignition command 11*a* is output to the power running ignition circuit 12, which controls the power running thyristor device 6.

On the other hand, when the deviation VPT is negative, the switch 113 switches over to the damping gain setting circuit 115, so that the electric power command signal from the phase/gain compensating circuit 112 is input to the damping gain setting circuit 115.

Figure 4:
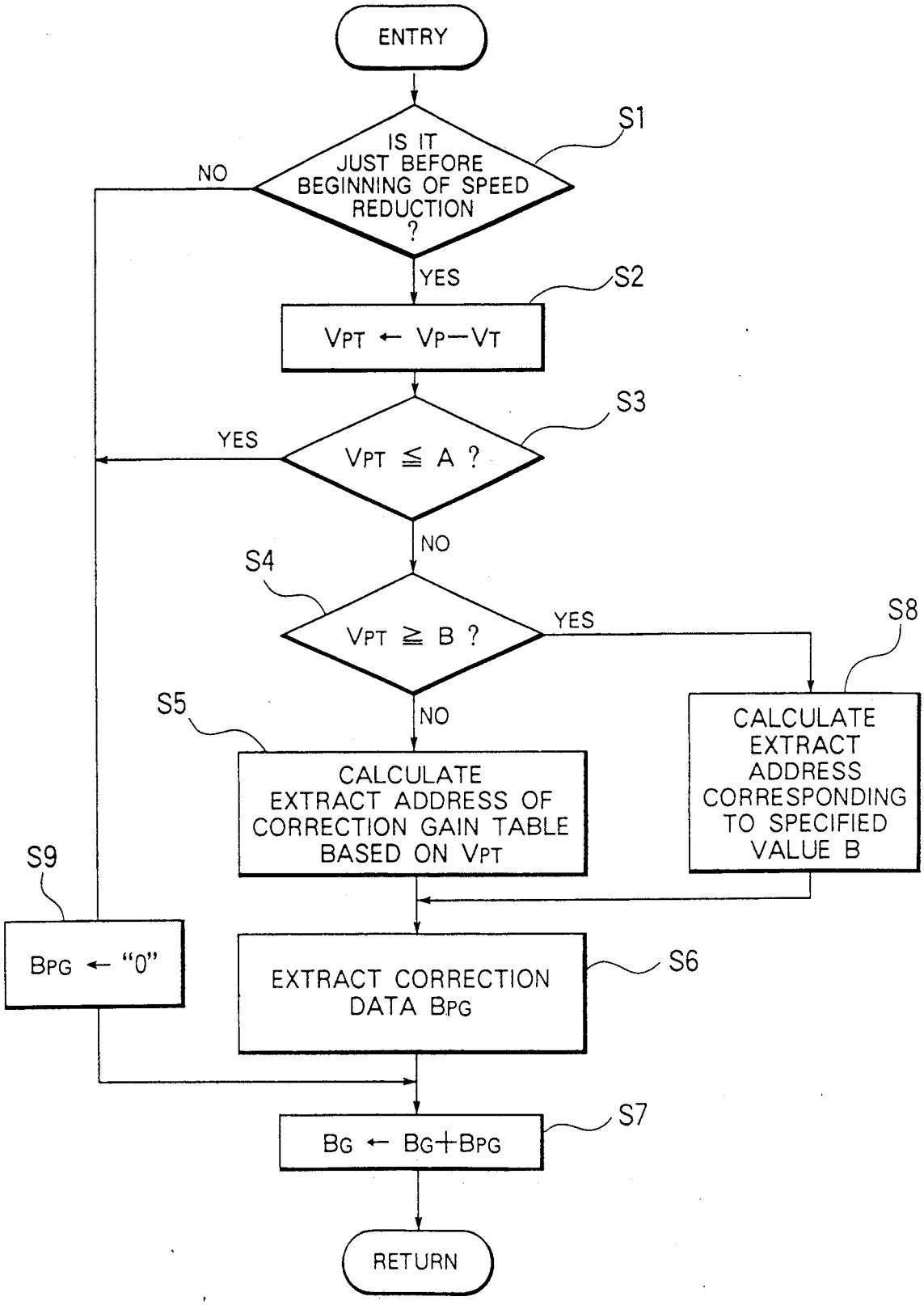
FIG. 4 is a flow chart showing the operation of the speed control circuit.
Figure 6:
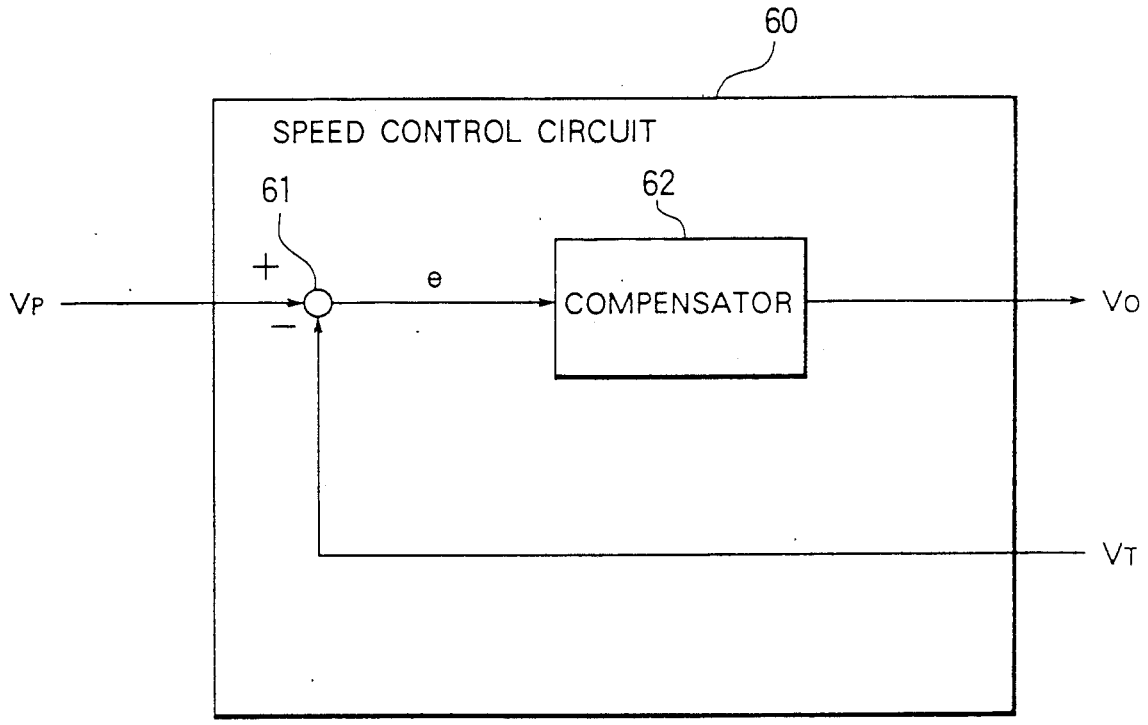
FIG. 6 PRIOR ART
FIG. 6 is a block diagram illustrating a conventional elevator control apparatus.

The operation of the speed control circuit 11 in the latter case will now be described with reference to the flow chart of FIG. 4. In step S1, it is determined, on the basis of the speed command signal VP output from the speed command generating circuit 10, whether or not it is just before the beginning of the speed reduction of the elevator. If it is determined that it is just before the beginning of the speed reduction, in step S2, the deviation VPT between the speed command signal VP and the speed detecting signal VT is computed, and in step S3, whether or not the deviation VPT exceeds a preset first specified value A is determined. If it is determined that the deviation VPT exceeds the first specified value A, it is recognized that the power source voltage has dropped, and in step S4, whether or not the deviation VPT exceeds another preset second specified value B (>A) is determined. If the deviation VPT does not exceed the second specified value B, in step S5 an extract address of the correction gain table 115*a* is computed based on the deviation VPT, and further in step S6 the correction data BPG of the extract address is extracted from the correction gain table 115*a*. In step S7, correction data BPG which has been extracted in step S6 is added to the damping gain BG output up to that point from the phase/gain compensating circuit 112. This added gain becomes another new damping gain BG that compensates for the insufficient gain.

On the contrary, in step S4, if it is determined that the deviation VPT exceeds the second specified value B, in order that the gain not become too high, an extract address corresponding to the second specified value B is computed before the logical sequence of a program for the damping gain setting circuit 115 proceeds to step S6.

Moreover, if it is determined that in step S1 it is not just before the beginning of the speed reduction, and that in step S3 the deviation VPT does not exceed the first specified value A, then it is determined that no compensation for the damping gain BG is required, and thus the correction data BPG is set to 0 in step S9. The logical sequence then proceeds to step S7.

Figure 5:
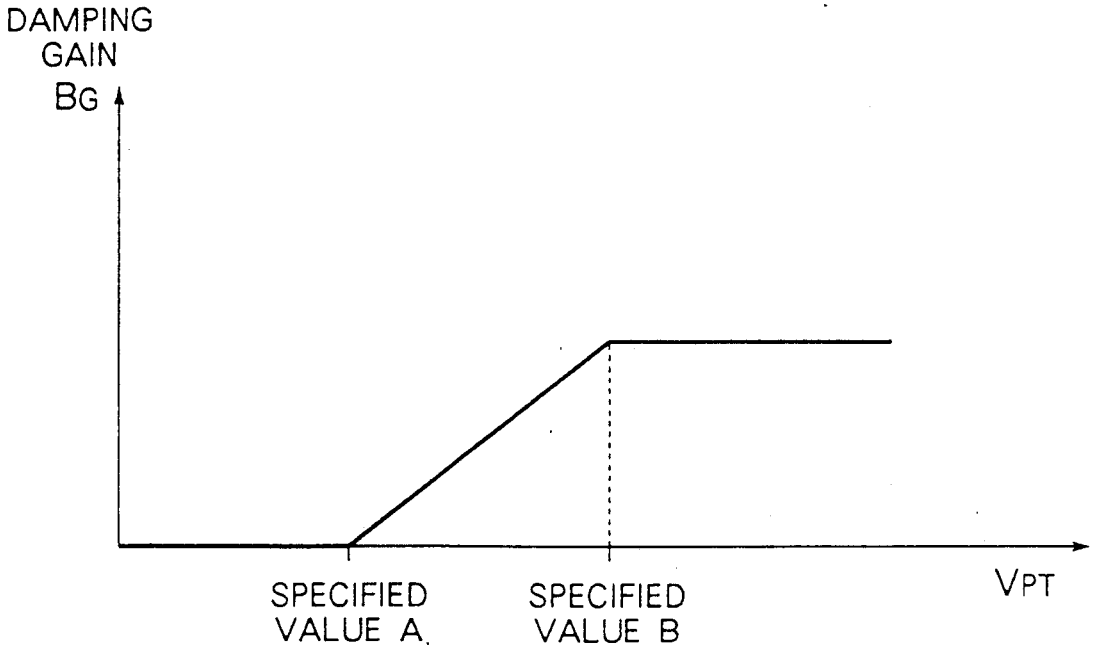
FIG. 5 is a graph showing a damping gain attained by the embodiment.

With this, the damping gain BG is controlled as illustrated in FIG. 5. That is, if the speed deviation VPT is the first specified value A or less, the damping gain BG compensated for in the phase/gain compensating circuit 112 is directly used without compensating for it, while on the contrary, if the speed deviation VPT is more than the first specified value A and less than the second specified value B, the damping gain BG increases in accordance with the deviation VPT. Further, if the speed deviation VPT is the second specified value B or more, the damping gain BG is fixed to the value corresponding to the second specified value B.

As has been explained, the non-linear elements of an electric power control signal, having been output from the damping gain setting circuit 115 and representing the damping gain BG, are compensated for in the compensator 117 before the linear damping ignition command **11*b* is output to the damping ignition circuit 13, which controls the damping thyristor device 8**.

According to the present invention, the elevator control apparatus is constructed such that because an insufficient gain BG corresponding to the deviation between the speed command signal VP and the speed detecting signal VT just before the beginning of the speed reduction of the elevator (or prior to the speed reduction) is extracted from the correction gain table, and the extracted gain BG is added to the damping gain BG, which has been obtained up to this point, so as to compensate for the damping gain, it is possible to control highly accurately stopping at a floor regardless of variations in the power source voltage or the like, thereby improving riding comfort. Though a method in which the calculation of the correction gain is extracted from the table has been described, the correction gain may also be attained by computation.

As many apparently widely different embodiments of the present invention can be made without departing from the spirit and scope thereof, it is to be understood that the invention is not limited to the specific embodiment thereof except as defined in the appended claims.

What is claimed is:

1. An elevator control apparatus comprising:

electric power control means for controlling electric power for feeding to an electric motor which drives the car of an elevator;

speed command generating means for generating a speed command signal of said car;

speed detecting means for detecting the speed of said car;

computing means for calculating the deviation between a speed detecting signal obtained by said speed detecting means and a speed command signal generated by said speed command generating means;

compensating means for outputting an electric power command signal in which gain properties and phase properties have been compensated in accordance with the deviation calculated by said computing means;

comparing means for determining whether or not the deviation calculated by said computing means exceeds a first specified value; and damping gain setting means for, when said comparing means determines that said deviation exceeds said first specified value, adding a correction value which is based on said deviation to the electric power command signal from said compensating means in order to output the added correction value as an electric power control signal to said electric power control means.

2. An elevator control apparatus according to claim 1, wherein when said comparing means determines that said deviation is not more than said first specified value, said damping gain setting means outputs the electric power command signal from said compensating means to said electric power control means as an electric power control signal.

3. An elevator control apparatus according to claim 1, wherein said comparing means has a second specified value which is more than said first specified value, and wherein when said comparing means determines that said deviation is not less than said second specified value, said damping gain setting means adds a correction value corresponding to said second specified value to the electric power command signal from said compensating means in order to output the added correction value to said electric power control means as an electric power control signal.

4. An elevator control apparatus according to claim 1, wherein said electric power control means includes thyristor devices.

* * * * *